US007887084B2

(12) United States Patent
Howell

(10) Patent No.: US 7,887,084 B2
(45) Date of Patent: Feb. 15, 2011

(54) ALPINE SKI BINDING HEEL UNIT

(75) Inventor: Richard J. Howell, Stowe, VT (US)

(73) Assignee: KneeBinding, Inc., Stowe, VT (US)

( * ) Notice: Subject to any disclaimer, the term of this patent is extended or adjusted under 35 U.S.C. 154(b) by 668 days.

(21) Appl. No.: 12/001,436

(22) Filed: Dec. 11, 2007

(65) Prior Publication Data

US 2008/0179862 A1 Jul. 31, 2008

Related U.S. Application Data

(62) Division of application No. 10/780,455, filed on Feb. 17, 2004, now Pat. No. 7,318,598.

(60) Provisional application No. 60/448,645, filed on Feb. 18, 2003.

(51) Int. Cl.
*A63C 9/084* (2006.01)

(52) U.S. Cl. ..... 280/628; 280/634

(58) Field of Classification Search ..... 280/618, 280/624–627, 629, 632, 634
See application file for complete search history.

(56) References Cited

U.S. PATENT DOCUMENTS

| | | | | |
|---|---|---|---|---|
| 2,676,813 | A | 4/1954 | Beyl | |
| 3,578,350 | A * | 5/1971 | Suhner | 280/626 |
| 3,606,370 | A | 9/1971 | Spademan | |
| 3,610,650 | A | 10/1971 | Korger et al. | |
| 3,620,545 | A * | 11/1971 | Korger et al. | 280/632 |
| 3,695,625 | A * | 10/1972 | Salomon | 280/626 |
| 3,727,932 | A | 4/1973 | Druss et al. | |
| 3,734,520 | A * | 5/1973 | Hashioka | 280/632 |
| 3,734,522 | A | 5/1973 | Salomon et al. | |
| 3,773,344 | A | 11/1973 | Wilkes | |
| 3,825,273 | A | 7/1974 | Greene | |
| 3,865,388 | A | 2/1975 | Haldemann | |
| 3,897,076 | A | 7/1975 | Beyl | |
| 3,902,728 | A | 9/1975 | Salomon et al. | |
| 3,905,613 | A | 9/1975 | Romeo | |
| 3,909,029 | A | 9/1975 | Salomon et al. | |

(Continued)

OTHER PUBLICATIONS

Minutes to ASTM F-27 Skiing Safety Meeting, Burlington, VT, Jul. 20-21, 2002.

*Primary Examiner*—J. Allen Shriver, II
*Assistant Examiner*—Bridget Avery
(74) *Attorney, Agent, or Firm*—Wilmer Cutler Pickering Hale and Dorr LLP

(57) ABSTRACT

Ski binding heel unit includes lateral release cams and a vector decoupler mechanism that provide lateral shear release of the heel of a ski boot from a ski. The ski binding heel unit includes an independent vertical heel release mechanism, independent lateral release mechanism and a forward pressure compensator. The lateral release cams have laterally outwardly flaring contact points. The vector decoupler mechanism restricts heel unit lateral rotation and translation to a control path. The shape of the lateral release cams dictates the control path. The vector decoupler mechanism redirects the non-lateral forces without effecting the vertical heel release, lateral heel release or forward pressure compensator. The lateral release cams and vector decoupler mechanism avert non-lateral, benign loads from the lateral heel release, and avert non-vertical, benign loads from the vertical heel release thereby reducing the incidence of inadvertent pre-release of a boot from a ski.

18 Claims, 4 Drawing Sheets

U.S. PATENT DOCUMENTS

| | | | | | |
|---|---|---|---|---|---|
| 3,936,062 | A | | 2/1976 | Schweizer et al. | |
| 3,992,032 | A | | 11/1976 | Swenson | |
| 4,052,086 | A | | 10/1977 | Eckart | |
| 4,065,151 | A | | 12/1977 | Weinstein et al. | |
| 4,070,034 | A | | 1/1978 | Swenson | |
| 4,111,453 | A | * | 9/1978 | Krob | 280/626 |
| 4,183,549 | A | * | 1/1980 | Salomon | 280/632 |
| 4,264,088 | A | | 4/1981 | Replogle | |
| 4,266,806 | A | * | 5/1981 | Weigl et al. | 280/618 |
| 4,268,064 | A | | 5/1981 | Svoboda et al. | |
| 4,286,801 | A | | 9/1981 | Richert et al. | |
| 4,288,094 | A | | 9/1981 | Svoboda et al. | |
| 4,288,095 | A | | 9/1981 | Wittmann et al. | |
| 4,294,461 | A | | 10/1981 | Eckart et al. | |
| 4,307,898 | A | | 12/1981 | Schmidt et al. | |
| 4,429,896 | A | | 2/1984 | Spademan | |
| 4,444,413 | A | * | 4/1984 | Richert et al. | 280/632 |
| 4,449,731 | A | * | 5/1984 | Knabel et al. | 280/632 |
| 4,451,059 | A | * | 5/1984 | Knabel et al. | 280/632 |
| 4,466,634 | A | * | 8/1984 | Knabel et al. | 280/632 |
| 4,475,743 | A | * | 10/1984 | Wittmann | 280/632 |
| 4,489,956 | A | * | 12/1984 | Jungkind | 280/632 |
| 4,553,772 | A | | 11/1985 | Boussemart et al. | |
| 4,602,804 | A | * | 7/1986 | Spitaler et al. | 280/632 |
| 4,625,991 | A | * | 12/1986 | Leichtfried | 280/632 |
| 4,753,452 | A | | 6/1988 | Boussemart et al. | |
| 4,758,017 | A | * | 7/1988 | Stritzl et al. | 280/618 |
| 5,160,159 | A | * | 11/1992 | Gorza et al. | 280/632 |
| 2002/0101063 | A1 | | 8/2002 | Dodge | |

* cited by examiner

ALPINE SKI BINDING HEEL UNIT

CROSS-REFERENCE TO RELATED APPLICATIONS

This application claims priority to U.S. Provisional Application Ser. No. 60/448,645, filed on Feb. 18, 2003, and is a Divisional patent application of U.S. patent application Ser. No. 10/780,455, filed on Feb. 17, 2004, entitled ALPINE SKI BINDING HEEL UNIT, under 35 U.S.C. §119(e) which is expressly incorporated herein by reference in its entirety.

BACKGROUND

This invention relates in general to alpine ski bindings and, in particular, to multi-directional release alpine ski binding heel units that release in the vertical and lateral directions.

Ski binding heel units have a jaw that is adapted to hold a boot and move between a boot retention position and a release position. The jaw vertical pivots around an axis transverse to the longitudinal axis of the ski and/or binding against the action of an elastic system. The elastic system comprises a mobile member biased by a spring against a release incline on a support attached to the ski. Vertical heel release bindings have serious disadvantages because vertical release bindings only release the ski when there is downward stress imparted by the skier on the ski where the area of applied stress is located in front of the boot's fulcrum point, which fulcrum is typically located under the ball of the foot; or release the ski when there is an upward stress applied to the ski by the skier when the skier is turned backwards in a fall with the top/aft section of the ski being dragged in the snow. Ski binding heel units that only release vertically rely on the mating ski binding toe units (which toe units release in response to lateral stresses or in the case of multi-directional toes units, release in response to lateral and special vertical stresses), which in the case of multi-directional release toes that provide vertical release in response to vertical stresses applied to the ski by the skier to the top after-body section of the ski during pure backward falls and release vertically at the toe in response to vertical stresses being applied by the snow surface when the skier is backwards and the tip of the ski is being dragged in the snow. Heels that release only in the vertical direction rely on the mating ski binding toe units to provide lateral release in response to lateral stresses that enter the fore-body of the ski during forward twisting falls and in response to pure straight-downward twisting loads where an almost pure-torque is applied to the ski. Accordingly, with heels that only provide vertical release, lateral release of the ski from the boot is not possible when lateral forces are applied to the ski immediately under or near the heel that only releases vertically.

In an equal- and opposite vernacular, the boot can release from the ski, or the ski can release from the boot.

All alpine ski bindings provide lateral toe release to release the ski from the boot when a transverse-longitudinal (side of the ski) force is applied to the ski at all points along the ski, except where a lateral force is applied to the ski immediately under or near a non lateral releasing heel. A heel that releases in the vertical direction only which relies on a lateral releasing toe can be dangerous to the knee in the event of lateral forces being applied to the ski immediately under a heel that only provides vertical release, because a lateral force applied to a non-releasing ski, under a non-lateral releasing heel, can act over the entire length of the lower leg to generate a moment about the femur when the knee is bent at nearly 70-degrees to 110-degrees, which femur is semi-rigidly attached to the hip, thereby producing very high strain across the anterior cruciate ligament of the knee, often causing rupture of the ACL Heel unit bindings that release both vertically and laterally have been proposed. Multi-directional heel unit bindings can have a jaw that laterally pivots around a vertical axis located on the longitudinal plane of symmetry of the ski or a jaw mounted on a universal joint and biased to a centered retention position by an elastic locking system. These heel unit bindings, however, have serious disadvantages. These disadvantages include unsatisfactory lateral and vertical retention of the ski to the boot.

Multi-directional release bindings that exhibit unsatisfactory lateral and vertical ski retention fail to retain skis to boots during normal controlled skiing which gives rise to a condition called pre-release. Pre-release occurs when a ski binding releases a ski during normal controlled skiing. Pre-release can be caused by an undesired relationship between the vertical forces, the lateral forces, the fore-and-aft forces, the forward and backward bending moments, the torsional moments (pure torques) and the roll moments (edging loads) that enter the binding To overcome pre-release, some skiers manually increase the release level biasings of the ski binding which increases the retention of the ski to the boot in the binding. The increase in release level offsets inadvertent pre-release. However, the increase in retention also increases the release level, negating the original benefits that multi-directional bindings are intended to resolve.

Many of the multi-directional heel release bindings have offered the promise of improved release but have failed to provide adequate retention in practice. Consequently, previous multi-directional heel bindings do not meet fundamental design requirements of an alpine ski binding including providing proper retention of a ski to a boot during controlled skiing maneuvers There is also one multi-directional heel unit which provides false-positive retention, because it provides retention during controlled skiing, but fails to allow proper lateral heel release when roll moments (from edging) are induced into the binding, and is being taken to market, regardless, because there is no international standard that tests for the effects of induced roll moments on proper lateral heel release. Therefore, in this special case, the important promise of multi-directional release is not present during edging, which is almost always occurring during controlled and uncontrolled skiing (potentially injurious falls).

Despite improvements in multi-directional toe release bindings, the incidence of knee injuries continues to increase. Frequently the anterior cruciate ligament (ACL) of knee is strained or ruptured. ACL strain intensifies when lateral forces are applied to the ski immediately under or near the projected tibial axis (coaxial with the tibia), generally known as phantom-foot fall kinematics. In phantom-foot falls a lateral heel release binding will avert ACL strain. For example, when the knee is in a flexion angle of approximately 70 to 110-degrees, lateral forces applied to the bottom of the project tibia axis generate a torque about the femoral axis when the hip is semi-fixed. Due to the long length of the lever-arm from the base of the ski, including the thickness of the ski, the thickness of the binding (often also including "under-binding devices"/plates), the thickness of the heel section of the boot sole and the long length of the tibia), this high leverage generates a large torque about the femur where the instant unit stress through the knee is applied as strain to the ACL. In this frequent circumstance, a lateral heel release binding could release. However, a multi-directional heel release binding that accommodates the release of the ski in the above described situation, which provides proper lateral release during edge-induced roll moments and also prevents pre-release during normal skiing conditions has yet to be reduced to practice.

Pre-release in a multi-directional release heel (that provides release in the lateral and vertical directions) is primarily caused by an improper cross-linking of the design of the lateral and vertical release mechanisms; or by the cross-linked design of the mechanisms that control lateral, vertical, longitudinal, roll (induced edging), and forward and backward bending moments, causing the pure lateral release mode or the pure vertical release mode (the injurious modes) to become overloaded by the linked addition of the other non-lateral and non-vertical stresses (non-injurious/innocuous modes), by excessive friction between the release interfaces (low friction interfaces not only improve combined-loading release, but also enhance the rapid re-centering of the ski to the boot during innocuous stresses), and by insuring that the fitting adjustments that properly connect the binding to the individual sizing of the boot are correct.

In related art with a multi-directional heel release, a center release mechanism is used. However, center release mechanisms show evidence of internal friction, especially during induced roll moments from edging. Furthermore, snow can be forced into the front end of the binding where the moving twist release interface resides between the bottom side of the binding and the ski. The snow builds up, and when compressed by the cyclical action of ski flex and counter-flex, forms an expanding layer of ice that greatly increases the resultant twist release. The presence of snow and ice melts deposits large amounts of dirt and grit in the release interfaces. The deposition greatly increases the resultant twist release and subsequent resultant torsional loading induced into the tibia during combined forward twisting falls, by as much as 300%, easily causing a fractured tibia.

A multi-directional release binding that takes into consideration the aforementioned intricacies and prevents pre-release has not been reduced to practice.

SUMMARY OF THE INVENTION

An alpine ski binding heel unit is disclosed that includes a primary vertical release, lateral heel release and longitudinal pressure compensator. The primary vertical release, lateral heel release and longitudinal pressure compensator are de-linked from each other. That is, they are functionally independent mechanisms. The forward release, the lateral heel release, and longitudinal pressure compensator include independent adjustment.

In one embodiment, the lateral heel release includes a lateral release cam. The lateral release cam features a decisively controlled level of release effort as the heel of the boot displaces from the longitudinal center of the ski. The lateral release cam and similarly matched cam interface include two pairs of individual cam members. Each pair includes a left individual cam member and right individual cam member for lateral heel release in the left and right direction, respectively. The individual cam member comprise rounded faces such that during dynamic motion of the lateral release only one or two cam members are in contact with the matched cam interface. The lateral release cam restricts the movement of the lateral heel release to a predetermined path of both rotation and translation. The shape of the individual cam members and the matched cam interface define this predetermined path.

In one embodiment, the left and right side individual cam members are shaped symmetrically providing similar lateral release in either the inward or outward directions. In another embodiment, the two sides are shaped asymmetrically to provide unequal release in the inward and outward directions. The asymmetry is shaped so that the gross features of the individual cam members are either curved toward the fore body of the ski or curved aft toward the after-body of the ski. Curving forward increases the net lateral release, while curving aft decreases the net lateral release.

During dynamic actuation, the shape of the individual cam members shifts the instant center of contact between the lateral release cam and the matched cam interface. The contact center during its initial phase of lateral movement is at the inner pair of individual cam members. Specifically, one of the individual cam members (left or right) will contact the matched cam interface during the initial phase of lateral release. Then, during the latter phase of lateral movement, the contact center shifts from the inner pair to the outer pair of individual cam members (either left or right).

Analytically, the lateral heel release includes an incremental lever arm that resists lateral motion. The incremental lever arm is defined by the distance between the point of contact between the tension shaft and the point of contact on the lateral release cam. The incremental lateral release cam tilts during initial and latter phases of release. The lateral release cam tilt allows the instant lateral center of effort (from the longitudinal pressure) of the boot to shift laterally to a point that is farther away from the concentrated point of contact. The rolling nature of the contact interface, defined by the lateral release cam and the matched cam interface, minimizes changes in the coefficient of friction within the cam interface of the lateral heel release mechanism.

Lateral release of the ski from the boot occurs after the instant lateral center of the boot's longitudinal pressure is displaced past the outer most individual cam member (either left or right). The incremental lever arm offsets an opposing lever arm of the lateral release spring-bias. When the boot's lateral instant center of longitudinal pressure is disposed near the outer pair of individual cam members, the ski, relative to the boot, can either continue to move laterally until release if the induced load increased, or the ski, relative to the boot, can be pulled back to center if the loading innocuously dissipates. The net effect of multiple lever arms as described above pulls the ski, relative to the boot, back to center.

In one or more embodiments, a vector decoupler mechanism separates and isolates undesired release conditions from intended release conditions. The vector decoupler mechanism filters events including induced roll loads (due to edging on snow or ice), forward bending moments, vertical forces and backward bending moments from the primary lateral and vertical heel release mechanisms. The vector decoupler prevents influence on objects including the lateral heel release, the vertical heel release and the longitudinal pressure compensator.

The vector decoupler mechanism includes a tongue that extends from the upper stem of the lateral release cam. The tongue moves between two plates disposed above and below the tongue. The two plates are stationary relative to lateral heel release and are a part of a lower heel unit housing The lower heel unit housing connects to the non-moving side of the lateral release cams.

The heel unit as described also provides the function of entry and exit into and out of the ski by virtue of the movement of the vertical release feature. Stepping upon a treadle latches the heel unit to the boot. The other protruding end of the heel unit can be stepped upon by the opposite ski, boot, pole or hand to effect stepping-out of (i.e., disengaging the boot from) the heel unit.

The vector decoupler mechanism filters out unwanted non-lateral loads away from the lateral release cam. The unwanted loads include those that occur when stepping-into the binding (as during latching the vertical release mechanism), those that occur during vertical only release, and those that occur during edging on snow or ice (roll moments).

The longitudinal pressure compensator includes a spring. The spring bias produces linear force between the boot and the jaw (heel interface of the binding) of the binding. Ski flex causes the spring to become compressed. In one embodiment, the longitudinal pressure compensator mechanism is semi-linked to the primary vertical heel release and lateral heel release mechanisms. Consequently, the longitudinal pressure on the lateral heel release mechanism and vertical release mechanism increases proportionally and predictably in the event of ski flex as a function of the spring rate of the forward pressure spring.

The design largely blocks the introduction of foreign matter into the lateral heel release cam mechanism, thereby not significantly affecting performance. The open space between the lateral release cam and the matching cam interface may be partially filled with a compressible rubber-like polymer to prevent the introduction of mud, road-salt and ice contaminates.

Another embodiment describes a heel pad, to which the heel area of the sole of the boot rests, which is coated with a low-friction element to minimize the lateral friction produced by normal forces (downward forces). An alternative describes a different coefficient of friction coating surface, such as, polytetrafluoroethylene (PTFE) or polypropylene. This low-friction interface maintains an expected level of lateral-twist release during the introduction of combined vertical-downward and roll loads, as primarily controlled by the spring-biased lateral heel release.

DETAILED DESCRIPTION

Figure 1:
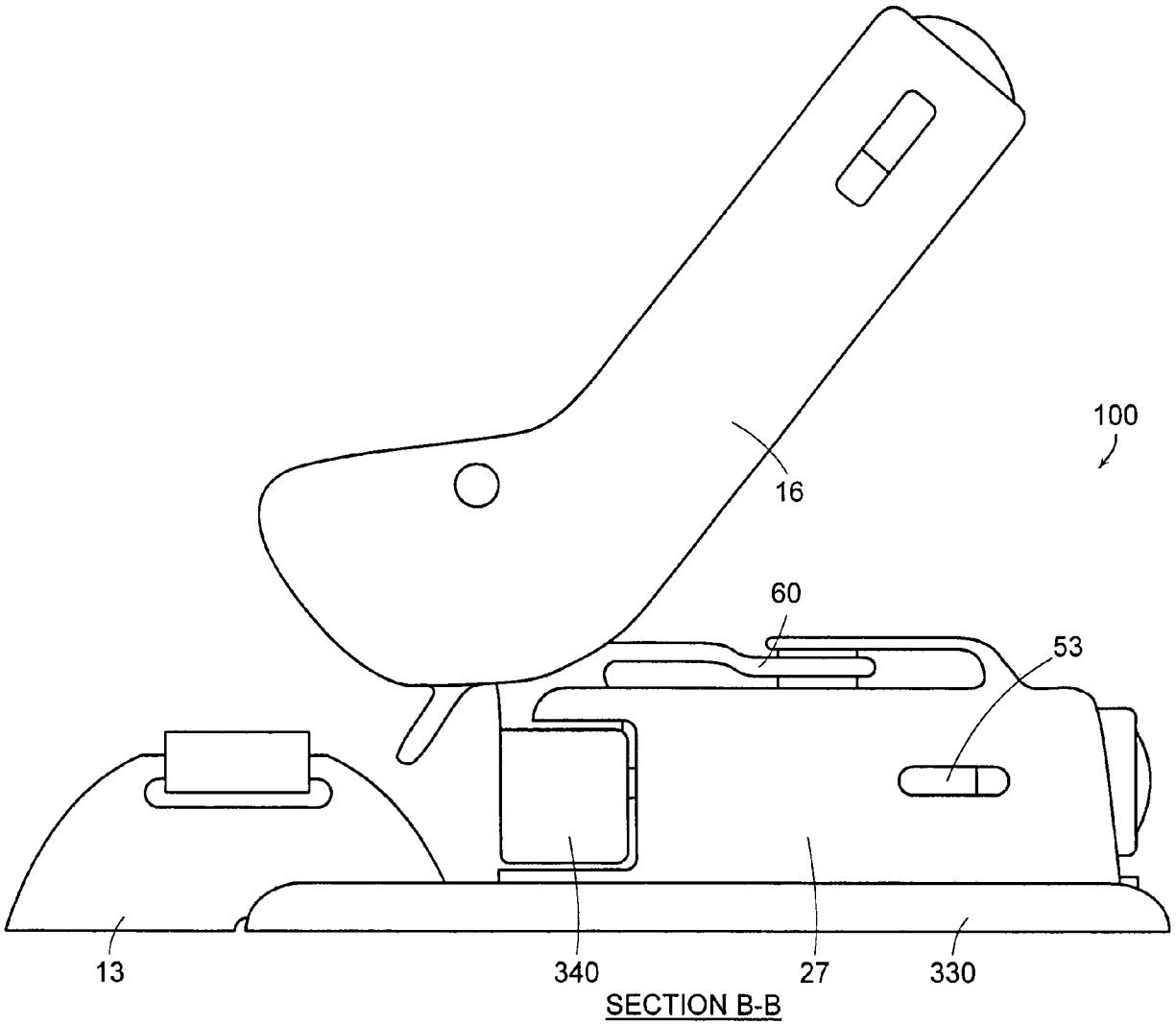
FIG. 1 illustrates a side view of the alpine ski binding heel unit.

FIG. 1 shows a sectional side view of a ski binding heel unit 100. The ski binding heel unit includes an upper heel housing 16, lower heel housing 27, heel pad 13, lateral release 340, interface support 330, and vector decoupler mechanism 60. Heel pad 13 connects to interface support. The heel housing is disposed on the lateral release 340, which is connected to the vector decoupler mechanism 60.

Figure 2:
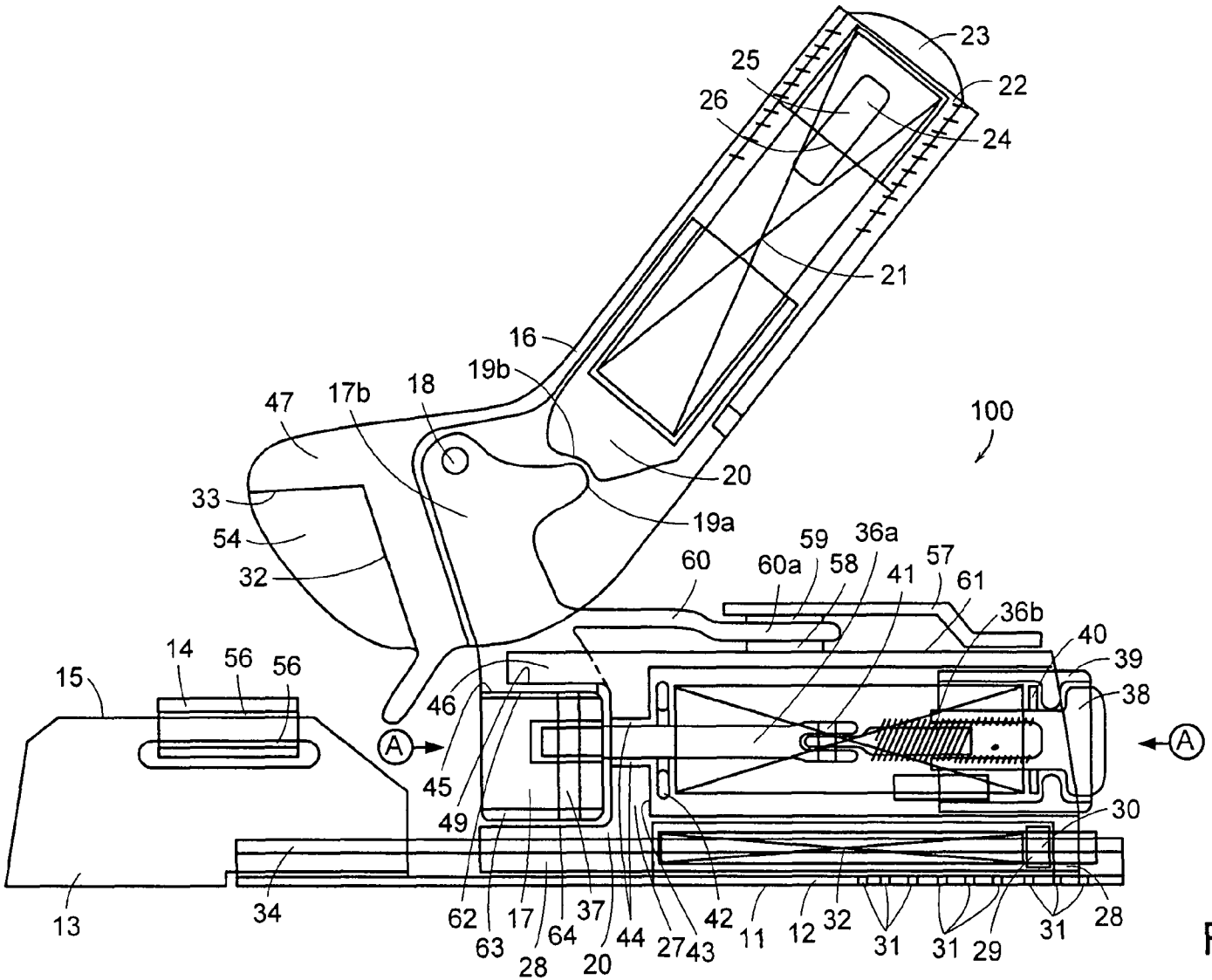
FIG. 2 is a more detailed side view of the heel unit of FIG. 1.

FIG. 2 details a side view of the alpine ski binding heel unit shown in FIG. 1. Upper Heel housing 16 includes a pivot rod 18, cam surfaces 19*a* and 19*b* stem section 17*b*, lateral release cam assembly 17, vertical release cam follower 20, vertical release spring 21, threaded cap 22, window 24, polymer piece 25, surface 26, region 33, and heel cup assembly 47.

As used herein, the longitudinal and horizontal plane of the ski is that plane which is parallel to the bottom surface of the ski. The longitudinal and vertical plane of the ski is that plane which is perpendicular to the longitudinal and horizontal plane of the ski and parallel to the longitudinal centerline of the ski.

Upper heel housing 16 connects to lateral release cam 17 by way of a pivot rod 18. Vertical release is a function of opposing vertical release cam surfaces 19*a* and 19*b* on the aft-most end of the upper one-third stem section 17*b* of lateral release cam 17, and the vertical release cam follower 20. The vertical release spring 21 (shown by an "X") in the large internal pocket of the upper heel housing 16 pushes cam follower 20. Forward release threaded cap 22 compresses the opposing end of spring.

A window 24 on surface 26 registers the release adjustment value. In one embodiment, a transparent polymer piece 25 covers the window 24. In a forward skiing fall, which generates a forward bending moment on the lower leg of the skier, the ski boot applies an upward vertical force to region 33 of the underside of heel cup 47 which heel cup is integral with upper heel housing 16.

The upper heel housing 16 holds and compresses a ski boot heel downward to oppose the upward forces generated by the ski boot during skiing. Forces include those from forward bending moments and roll moments generated during edging because region 33 and pivot rod 18 have a lateral width to resist such induced roll moments from edging. The skier removes the ski boot from the alpine ski binding heel unit by applying downward pressure to the top end of upper heel housing 16 with the opposite ski, opposite boot, by ski pole, or by an open hand.

Cam follower 20 moves along the length of the pocket of the long axis of upper heel housing 16 in response to upward vertical forces being applied to region 33 or in response to downward exiting forces applied to the upper end of upper heel housing 16. The shape of cam surfaces 19*a* and 19*b* control the relationship of the forces and corresponding displacement of cam follower 20, as biased by spring 21, which allows for the rotational displacement about a horizontal axis 18 of upper heel housing 16 and the vertical displacement of the ski boot in concert with region 33.

The vertical release cam follower 20 is made of plastic, while the moving lateral release cam 17/17*b* is made of coated die cast metal or injection molded plastic, although other suitable materials known in the art may also be used. The vertical release cam interface between cam surfaces 19*a* and 19*b* can be heavily greased with moderately high viscosity low-friction grease such as molybdenum disulfide or the like. The wicking action of cam surfaces 19*a* and 19*b*, as in the way an eye-lid functions, preclude mud, road-salt and ice from interfering with smooth vertical release cam action.

Interface support 330 includes bottom surface, stop-lock/nut 29, teeth 30, longitudinal spring 32, and lower carriage 12.

Lower carriage 11, connects to the top surface of a ski (not shown), to a riser plate (not shown), a lifter (not shown) or to an integral rail-system (not shown). Stop-lock/nut 29 has one or more teeth 30 to allow selective movement of lower heel housing 27 along the length of lower carriage 12 in conjunction with slots 31 that are formed in lower carriage 12. Turning stop-lock/nut 29 facilitates movement of lower heel housing 27 relative to lower carriage 12 to properly fit various lengths of ski boots between the lower heel housing 27 and an alpine binding toe piece (not shown).

In series with the stop-lock/nut 29 and lower heel housing 27 is longitudinal spring 32, which provides a spring bias between lower heel housing 27 and lower carriage 12. Longitudinal spring 32 also provides longitudinal pressure between the lower heel housing 27 and alpine binding toe piece to ensure proper hold of a boot during the ski's counter-flex. Counter-flex increases the strain on the top surface of the ski, thereby increasing the distance between the toe piece and heel unit 100. The longitudinal pressure maintains the contact of the binding's toe piece and heel unit 100 throughout the ski counter-flex. The lower heel housing 27 applies longitudinal pressure to the ski boot via the upper heel housing 16 at surface 32 of heel cup 47. An internal shoulder on stop-lock/nut 29 prevents the nut 29 from falling out of its opening at the end of the lower heel housing 27. Longitudinal pressure increases substantially during ski flex. Such pressure is addressed by the longitudinal pressure spring biasing means that is comprised of elements 32, 29, 30, 31 within lower heel housing 27.

The lower heel housing 27 fits to and integrates with lower carriage 12 by flanges 28. Specifically, flanges 28*a*, 28*b*, on each side of the lower heel housing 27, mate with lower carriage 12.

Heel pad 13 includes low-friction element 14, low-friction surface 15, and bearing grease 56. Low-friction element 14 is disposed on the heel pad 13 and is lubricated with bearing grease 56. In an alternate embodiment low-friction surface 15 and bearing grease 56 is replaced with a low-friction surface 15 to which a boot can contact. Low-friction means 14 and 15 provide smooth lateral heel release during combined downward-vertical and lateral stresses, which mitigate torque about the femur and correspondingly strained ACL. Low-friction means 14 and 15 contribute to rapid re-centering of the heel of a boot during innocuous lateral heel loads.

The vector decoupler assembly 60 includes cantilevered plate 57, vector decoupler tongue 60*a*, top surface 61, and low-friction elements 58 and 59.

The cantilevered plate 57 joins to the moving lateral release cam element 17. The low friction elements 58 and 59 are made of a low-friction polymer, such as polytetrafluoroethylene (PTFE), or are made of other low-friction materials or surfaces that are already well known in the art. One side of the low-friction element 58 bonds to a mating surface (not shown). For example, the top-side of low-friction element 58 can be bonded to the bottom side of vector decoupler assembly 60, allowing the low friction element 58 to slide while rotating and translating laterally. The translation occurs with the vector decoupler tongue 60*a* when a force is applied to the vector decoupler tongue 60*a* such that the vector decoupler tongue 60*a* is applied against top surface 61 of lower heel housing 27. Optionally, the bottom side of low-friction element 58 can be bonded to the top surface 61 of lower heel housing 27. Accordingly, the vector decoupler tongue 60 can rotationally and translationally slide laterally against low friction element 58. if the vector decoupler tongue is made of an aluminum die casting, a low friction coating (such as Teflon impregnated epoxy paint) is applied to the contact surfaces of the vector decoupler tongue 60*a* and the top surface 61 of the lower heel housing 27. Low friction coatings provide a low friction interface between the vector decoupler tongue 60 and the lower heel housing. If the vector decoupler tongue is made of injection molded plastic, the plastic material itself can be of a low coefficient of friction material without any coating, such as DuPont Delrin blended with PTFE, low-coefficient of friction grades of Nylon 12 or Nylon 66 or other low-coefficient of friction/high impact at low-temperature grades of plastics that are already well known in the art.

In a similar way, the top-side of low-friction element 59 bonds to the bottom side of cantilevered plate 57 so that the vector decoupler tongue 60*a* can slide smoothly while rotating and translating in the general lateral direction. Or, optionally, the bottom side of low-friction element 59 can be bonded to the top surface of the vector decoupler tongue 60*a* while the top surface of the low-friction element 59 slides by rotating and translating against the bottom side of the cantilevered plate 57. If the vector decoupler tongue is made of die castable aluminum, low friction coatings, such as Teflon impregnated epoxy paint, are applied to the contact surfaces of the vector decoupler tongue 60*a* and the bottom surface of the cantilevered plate 57. The application provides a low-friction interface between the vector decoupler tongue 60*a* and the cantilevered plate 57.

The vector decoupler assembly 60 has sufficient width between 1 cm and 3 cm in the lateral direction. The augmented width resists a roll moment induced by a skier. The width also resists the stresses induced in the roll direction when skiing on snow or icy surfaces when a boot is forced to overturn laterally (roll), so that an upward unit force is applied to one side of the lateral region 33 of the underside of heel cup 47 thereby decoupling the effects of induced roll moments from the vertical release mechanism—minimizing inadvertent pre-release. The resistance supplied by the vector decoupler substantially decouples the roll moment from the moving lateral release cam surfaces 17*c* and interfacing lateral release cam surfaces 27*a*, thereby decoupling the effects of induced roll moments from the lateral heel release.

The vector decoupler assembly 60 allows free lateral translational and rotational movement of the moving lateral release cam 17 relative to the lower heel housing 27. The vector decoupler assembly 60 also allows free coupling of moving lateral release cam 17 against the mating cam surfaces 27*a* in the presence of lateral heel release loads. This occurs even when induced roll moments and upward force vectors are applied through the vector decoupler assembly 60. Free coupling is partially limited by friction generated between the sliding surfaces of low-friction elements 58 and 59 and the respective mating surfaces of components 60*a* and 61. Component 61 can be affixed to the lower heel housing 27 by band 18 that wraps around the lower heel housing 27.

In an alternate embodiment, cantilevered plate 61 is formed integrally with lower heel housing 27 as an aluminum die-casting or as an injection molded plastic part. The long length of vector decoupler tongue 60*a* reduces the unit compressive stresses at the far end of the tongue, between its interfacing components, low-friction element 59 and cantilevered plate 61 during induced forward bending moments. The long length of vector decoupler tongue 60 also serves to reduce the compressive stresses between interfacing components, low friction element 58, and the lower heel housing 27 during the latching action of stepping into the lower heel housing 27.

Vector decoupler mechanism 60 above is de-coupled from longitudinal pressure loads generated between moving lateral release cam 17 and lower heel housing 27, due to the longitudinally-open linkage between tongue 60*a* and cantilevered plate 57. In another embodiment, the side-to-side movement of the tongue 60*a* may be limited either on one side or both sides and substantially restricted on one side to block lateral heel release in one lateral direction to cut the probability of lateral heel pre-release in half while at the same time allowing release in the other lateral direction to provide for the lateral stresses that cause the inward twisting abduction loads present in ACL ruptures, described in part by the phantom-foot injury mechanism/fall mechanics described above.

Figure 3:
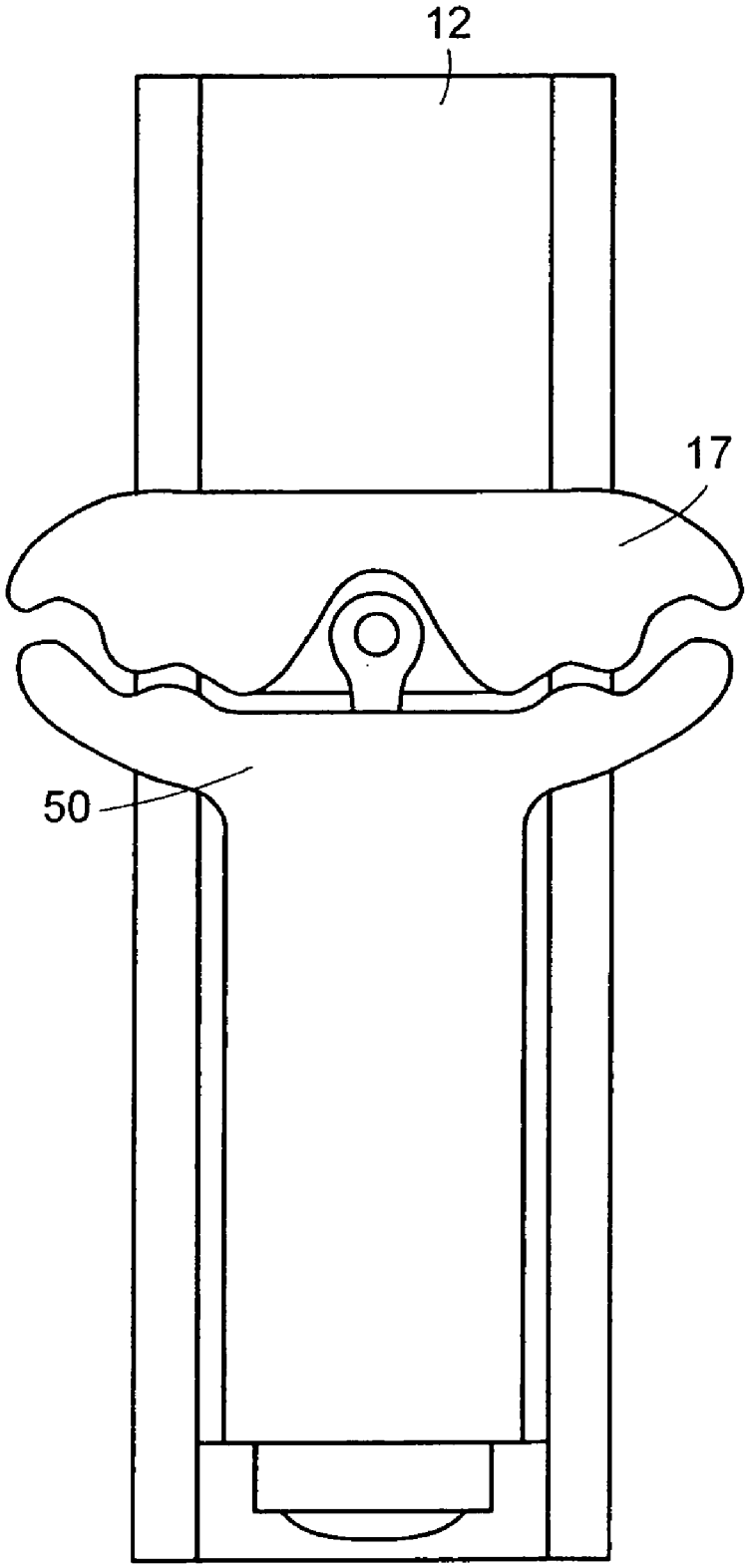
FIG. 3 illustrates a cross-sectional top view of a lateral release mechanism including the spring biasing; and, FIG. 4 is a more detailed cross-sectional top view of the lateral release mechanism of FIG. 3.
Figure 4:
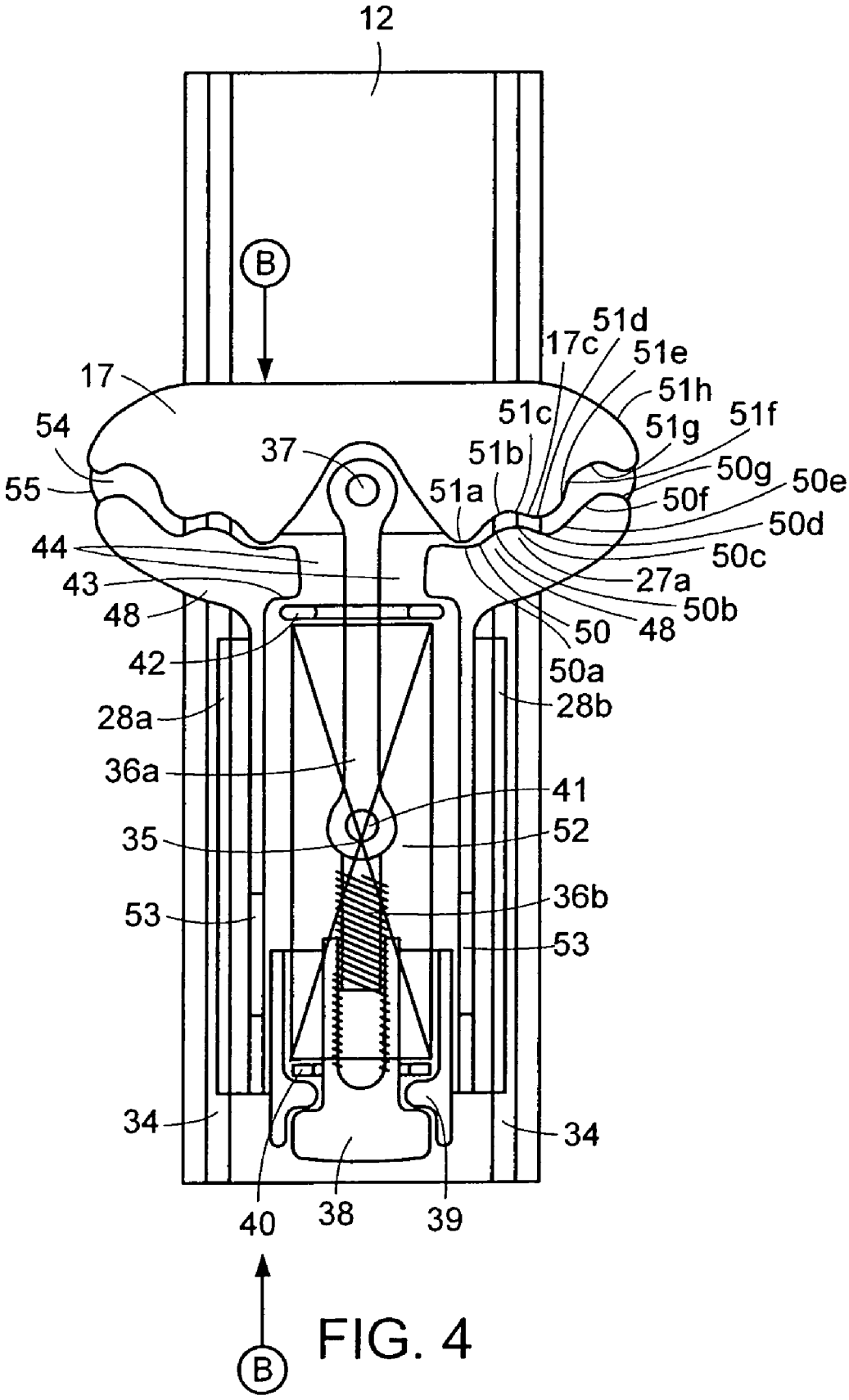

FIG. 3 illustrates a sectional top view of a lateral heel release mechanism. FIG. 4 shows the view of FIG. 3 in greater detail. Lateral release cam 17 is disposed next to matched cam interface 50. Both lateral release cam 17 and matched cam interface is disposed on top of lower carriage 12. Lateral release 340 includes lateral release cam 17, matched cam interface 50, spring biasing means 52, lateral heel release spring 35, tension shaft parts 36*a* and 36*b*, connector rod 41, shaft-rod 37, lateral release indicator washer 39, internal washer 40, integral opening 44, rectangular opening washer 42, and interface curved surfaces 51*a*, 51*b*, 51*c*, 51*d*, 51*f*, 51*g*.

Referring to FIGS. 2 and 4, the lateral heel release mechanism comprises lateral release cam surfaces 17*c* and lower heel housing lateral cam surfaces 27*a*, which are biased (i.e., forced together) by lateral heel spring-biasing component 52. Lateral spring biasing component 52 includes lateral heel release spring 35 that is placed in compression by the opposing force of the tension shaft parts, 36*a* and 36*b* (or by optional unitary tension shaft 36), and connector rod 41. These are supported at each tensioned two ends of the rod(s). At one end, shaft-rod 37, lateral release cam 17, and rectangular opening washer 42 support the equal and opposite compression against internal wall 43 of lower heel housing 27. At the other end, lateral release threaded cap 38, lateral release indicator washer 39, internal washer 40 support the equal and opposite compression of the tension rod(s). Internal opening 44 and the internal opening of rectangular opening washer 42 are both rectangular in shape to permit tension shaft 36*a* (or 36) to rotate and translate laterally upon the lateral movement of moving lateral release cam 17. While the vertical gaps of internal opening 44 and the vertical gaps of rectangular opening washer 42 are each smaller than their respective lateral gaps, such vertical gaps restrict the vertical movement of tension shaft 36*a* (or 36), so that upper heel housing 16 provides vertical movement of the ski binding heel unit about its pivot axis 18, rather than by the forced vertical movement of other elements.

Lateral heel release cam surfaces allow the lateral release cam 17 to both rotate and translate relative to the lower heel housing 27, so that the heel area of the ski boot can displace laterally relative to the long axis of the ski. Boot displacement occurs when lateral loads are induced. Such lateral movement of the boot occurs across low-friction element 14 and heel pad top surface 15, as well as laterally against heel cup 47 boot-interface surfaces 32 and 33.

The lateral release cam surfaces 17*c* and 27*a* of the lateral release cam 17 and the mating cam surfaces 27*a* of the lower heel housing 27 displace relative to each other in a path described by their curved surfaces—specifically, curved surfaces 50*a*, 50*b*, 50*c*, 50*d*, 50*f*, 50*g* and their respective incremental interface curved surfaces 51*a*, 51*b*, 51*c*, 51*d*, 51*f*, 51*g*.

A partial lateral boot heel displacement occurs when the projected longitudinal-pressure center-of-effort between the boot and the heel cup 47 shifts laterally and the moving lateral release cam 17 tilts by rotating and translating a small amount, biased by lateral heel release spring 35. During such a partial lateral boot heel displacement, the opposing curved cam surfaces 50*a*, 50*b*, 50*c*, 50*d*, 50*f*, 50*g* move by translating and rotating (tilting) from their at-rest position to the next point of cam contact 50*c* and 51*c*, biased by lateral heel release spring 35. Accordingly, cam surfaces 50*b* and 51*b* space apart the "a-a" (as in 50*a* and 51*a*) surfaces from the "c-c" surfaces to provide an incremental lever arm. The incremental lever arm permits lateral translational and rotational movement of 17 relative to 27*a*. The at-rest position is defined to be when the surfaces on the symmetrically opposite side of the lower heel housing 27 are touching each other. For example, the at-rest position occurs when surfaces 50*a* and 51*a* are contacting each other.

As the heel of the boot continues to move laterally and lateral release cam 17 rotates and translates more to the point where cam surfaces "c-c" touch, a reverse-polarity lever-arm is generated that vector-adds to the spring bias effect of 52. The resultant incrementally abates the rotational and translational movement of lateral release cam 17. The abatement acts to re-center lateral release cam 17 toward its at-rest position, thereby providing incremental retention in the advent of large amounts of longitudinal pressure between the boot and lateral release cam 17, which would otherwise cause inadvertent pre-release. If the lateral load at the heel persists in magnitude and/or and duration, the boot's instant center of effort of longitudinal pressure then shifts outside of cam contact surfaces "c-c" to release the ski from the boot quickly and efficiently as is the case with ACL injury producing loads.

A similar benefit results if a load continues to persist in magnitude and duration while lateral release cam 17 continues to translate and rotate past the boot's projected longitudinal pressure shifts "outside" of cam contact surface "e-e." This reverses the polarity of the lever arm that acts perpendicular to the boot's projected center of effort of longitudinal pressure, thereby vector-subtracting from spring biasing means 52 to precipitate efficient release. Cam surfaces "f-f" begin to separate as cam surfaces "g-g" contact one another.

Finally, when cam surfaces "g-g" contact and the boot's projected instant center of longitudinal pressure shifts "outside" of cam surface contact point "g-g", the perpendicular lever arm finally reverses polarity again to vector-subtract from the spring bias 52, causing the moving lateral release cam 17 to rotate and translate toward lateral heel release.

The novel incremental vector additions and subtractions along the progressive cam surfaces that progress from cam surfaces "a-a" to cam surfaces "g-g" as described above, are also progressively effected by the increasing overall lateral lever arm generated between those cam contact surfaces and the reaction force of spring bias 52 applied at the instant-center-of-effort of shaft-rod 37. This arrangement makes lateral pre-release incrementally more difficult, the maximum point of release being a function of the exact spring constant of lateral heel spring 35, the amount of compression of spring 35 as controlled by lateral release threaded cap 38 (as indicated in lateral release level windows 53 on each side of lower heel housing 27). The maximum point of release is off-set by the incrementally decreasing longitudinal distance of the lever arm, between the lateral instant-center-of-contact of the side of the boot's heel and the lateral heel cup surface 54, to the instant-point of surface-contact on the progressive cam surfaces 17*c* and 27*a*.

If the moving progressive cam 17 were to rotate only about a central pivot located over the center of the ski, the alpine binding heel unit 10 would be too biased toward release and skiers would suffer from pre-release. On the other hand, if the moving progressive can were to rotate only about opposing cam surfaces "g-g" (as in 50*g* and 51*g*) the alpine binding heel unit would be too biased toward retention and skiers would suffer from ruptured ACL injuries. The progressive cams thus strike a decisive balance over release and retention by incrementally reversing polarity between release and retention during the course of lateral heel movement when moving cam 17 rotates and translates accordingly.

The kinematics of the incremental lateral release path of the boot relative to the ski can be controlled by the geometry of the mating cam surfaces as noted above. Adjustments to control the point of maximum lateral release can be adjusted by the compressive movement of lateral release threaded cap 38.

In one embodiment, a compressible elastomeric material 54 such as Dupont Crayton is placed between lateral release cam surfaces 27*a* and 17*c* to minimize the contamination effects of ice, mud and road-salt. Alternatively, a very highly elastic membrane 55 can be placed at the open end of the surfaces as a barrier to such contaminants. In yet another embodiment, the gap between the surfaces can remain open and exposed so that visual inspection of the gap can be easily performed by skiers or service technicians and because of the curved end surface of 51*h*. The curved end serves as a snow, ice and road-salt deflector to mitigate the practical effects of such environmental exposure. The entire lateral release mechanism including components 38, 39, 40, can be easily removed from parts 35, 36*a*, 36*b*, 41, 42, 37 and 17 to allow for periodic cleaning of the lateral release cam surfaces 17*c* and 27*a*. Snow pack does not build-up and compress into ice in the gap between 17*c* and 27*a* because the lateral orientation of the gap is at right angles to the direction of travel through the snow, mitigating the practical and important concerns about snow-pack and ice formation and its interference with lateral heel release.

Low-friction journals, or integral surfaces 62 and 63 of moving lateral release cam 17 further serve to decouple induced roll and vertical loads when acting against surfaces 49 and 64. They are, however, limited in their structural capacity due to the high unit stresses imposed on these surfaces. Such stresses exist because of the necessary restricted longitudinal lengths of elements 62, 63, 49 and 64, due to the need for the lower heel housing 27 to be compact in overall size, thereby causing the vector decoupler mechanism 60 to act in concert together with elements 62, 63, 49 and 64 to provide counter resistive fulcrum points as well as sliding bearing interface surfaces.

Other aspects, modifications, and embodiments are within the scope of the following claims.

What is claimed is:

1. A safety binding assembly for securing a heel portion of a ski boot to a ski, comprising:

a lower heel assembly attached to the ski, the lower assembly including a surface having a first plurality of cams disposed on either side of a longitudinal and vertical plane of the ski; and an upper heel assembly coupled to the lower heel assembly, including (i) a heel cup assembly for applying longitudinal securing pressure to the ski boot;

(ii) a lateral release assembly for applying lateral securing pressure to the ski boot, the lateral release assembly including a surface having a second plurality of cams, corresponding to and facing the first plurality of cams, disposed on either side of a longitudinal and vertical plane of the ski;

(iii) a vector decoupling assembly for separating and isolating two or more force vectors applied to the safety binding assembly; and, (iv) a lateral heel biasing component for biasing the surface having the second plurality of cams against the surface having the first plurality of cams wherein the lateral release assembly is constructed and arranged to pivot in a lateral and horizontal plane of the ski, against a force applied by the lateral heel biasing component, about any one of a plurality of cam axes each defined by a contact point of one of the first plurality of cams and one of the second plurality of cams, such that a lateral force applied to the heel portion of the ski boot in a direction perpendicular to the longitudinal and vertical plane of the ski causes the lateral release assembly to progressively pivot about consecutive cams, producing an incrementally increasing force opposing the lateral force applied to the heel portion of the ski boot, until the lateral release assembly rotates beyond a predetermined cam axis and releases the ski boot.

2. A safety binding assembly according to claim 1, wherein the first plurality of cams and the second plurality of cams are disposed symmetrically on either side of the longitudinal and vertical plane of the ski.

3. A safety binding assembly according to claim 1, wherein the first plurality of cams and the second plurality of cams are disposed asymmetrically on either side of the longitudinal and vertical plane of the ski.

4. A safety binding assembly according to claim 1, wherein the lower assembly includes a surface having four cams, two disposed on each side of the longitudinal and vertical plane of the ski.

5. A safety binding assembly according to claim 1, wherein the lower assembly includes a surface having six cams, three disposed on each side of the longitudinal and vertical plane of the ski.

6. A safety binding assembly according to claim 1, wherein the lateral heel biasing component includes (i) a first tension shaft having a first end and a second end, and a second tension shaft having a first end and a second end, pivotally attached to one another at the first end of each tension shaft via a connector rod; and, (ii) a spring coupled to the first tension shaft and the second tension shaft for resisting longitudinal movement of the first tension shaft and second tension shaft;

wherein the second end of the first tension shaft is pivotally attached to the lateral release assembly, and the second end of the second tension shaft is adjustably attached to the lower heel assembly.

7. A safety binding assembly according to claim 1, wherein the lateral heel biasing component includes (i) a tension shaft having a first end and a second end, the first end of the tension shaft being pivotally attached to the lateral release assembly, and the second end of the tension shaft being adjustably attached to the lower heel assembly; and, (ii) a spring coupled to the tension shaft for resisting longitudinal movement of the first tension shaft and second tension shaft.

8. A safety binding assembly according to claim 1, wherein the vector decoupling assembly includes a tongue component having a first end and a second end, the first end being fixedly attached to the lateral release assembly and the second end being disposed between a first surface fixedly attached to the lower heel assembly and a second surface fixedly attached to the lower heel assembly, such that the tongue component, the first surface and the second surface cooperate to allow motion of the lateral release assembly to occur only in the longitudinal and horizontal plane of the ski.

9. A safety binding assembly according to claim 1, wherein the lateral release assembly progressively pivots about consecutive cams so as to produce a consecutive series of vector additions and subtractions with respect to the biasing of the lateral heel biasing component.

10. A safety binding assembly according to claim 1, further including a contaminant blocking material disposed between the surface having the first plurality of cams and the surface having the second plurality of cams.

11. A safety binding assembly according to claim 1, further including a heel pad for reducing friction between a bottom surface of the heel portion of the ski boot and the safety binding assembly.

12. A safety binding assembly according to claim 8, wherein the tongue component, the first surface and the second surface cooperate to limit motion of the lateral release assembly to within a predetermined region within the longitudinal and horizontal plane of the ski.

13. A safety binding assembly for securing a heel portion of a ski boot to a ski, comprising:

a lower heel assembly attached to the ski, the lower assembly including a surface having a first plurality of cams disposed on either side of a longitudinal and vertical plane of the ski; and an upper heel assembly including (i) a lateral release assembly for applying lateral securing pressure to the ski boot, the lateral release assembly including a surface having a second plurality of cams, corresponding to and facing the first plurality of cams, disposed on either side of a longitudinal and vertical plane of the ski; and, (ii) a lateral heel biasing component for biasing the surface having the second plurality of cams against the surface having the first plurality of cams;

wherein the lateral release assembly is constructed and arranged to pivot in a lateral and horizontal plane of the ski, against a force applied by the lateral heel biasing component, about any one of a plurality of cam axes each defined by a contact point of one of the first plurality of cams and one of the second plurality of cams, such that a lateral force applied to the heel portion of the ski boot in a direction perpendicular to the longitudinal and vertical plane of the ski causes the lateral release assembly to progressively pivot about consecutive cams, producing an incrementally increasing force opposing the lateral force applied to the heel portion of the ski boot, until the lateral release assembly rotates beyond a predetermined cam axis and releases the ski boot.

14. A safety binding assembly according to claim 13, wherein the first plurality of cams and the second plurality of cams are disposed symmetrically on either side of the longitudinal and vertical plane of the ski.

15. A safety binding assembly according to claim 13, wherein the first plurality of cams and the second plurality of cams are disposed asymmetrically on either side of the longitudinal and vertical plane of the ski.

16. A safety binding assembly according to claim 13, wherein the lower assembly includes a surface having four cams, two disposed on each side of the longitudinal and vertical plane of the ski.

17. A safety binding assembly according to claim 13, wherein the lateral heel biasing component includes (i) a first tension shaft having a first end and a second end, and a second tension shaft having a first end and a second end, pivotally attached to one another at the first end of each tension shaft via a connector rod; and, (ii) a spring coupled to the first tension shaft and the second tension shaft for resisting longitudinal movement of the first tension shaft and second tension shaft;

wherein the second end of the first tension shaft is pivotally attached to the lateral release assembly, and the second end of the second tension shaft is adjustably attached to the lower heel assembly.

18. A safety binding assembly according to claim 13, wherein the lateral release assembly progressively pivots about consecutive cams so as to produce a consecutive series of vector additions and subtractions with respect to the biasing of the lateral heel biasing component.

* * * * *